US008404423B2

(12) United States Patent
Kim et al.

(10) Patent No.: US 8,404,423 B2
(45) **Date of Patent: *Mar. 26, 2013**

(54) PHOTORECEPTOR OUTER LAYER AND METHODS OF MAKING THE SAME

(75) Inventors: Woo Soo Kim, Oakville (CA); Gaetano J. Lavigne, Burlington (CA); Cuong Vong, Hamilton (CA); Johann Junginger, Toronto (CA); Vladislav Skorokhod, Mississauga (CA); Nan-Xing Hu, Oakville (CA)

(73) Assignee: Xerox Corporation, Norwalk, CT (US)

( * ) Notice: Subject to any disclaimer, the term of this patent is extended or adjusted under 35 U.S.C. 154(b) by 159 days.

This patent is subject to a terminal disclaimer.

(21) Appl. No.: 12/845,662

(22) Filed: Jul. 28, 2010

(65) Prior Publication Data

US 2012/0028178 A1 Feb. 2, 2012

(51) Int. Cl.
*G03G 21/00* (2006.01)
*G03G 15/20* (2006.01)

(52) U.S. Cl. ..... 430/119.7; 399/123; 399/346; 399/357

(58) Field of Classification Search ..... 430/66, 430/123.42, 132, 119.7; 428/141, 173; 399/346, 399/357

See application file for complete search history.

(56) References Cited

U.S. PATENT DOCUMENTS

| | | | | |
|---|---|---|---|---|
| 3,121,006 | A | | 2/1964 | Middleton et al. |
| 4,286,033 | A | | 8/1981 | Neyhart et al. |
| 4,291,110 | A | | 9/1981 | Lee |
| 4,338,387 | A | | 7/1982 | Hewitt |
| 4,387,980 | A | | 6/1983 | Ueno et al. |
| 4,464,450 | A | | 8/1984 | Teuscher |
| 4,587,189 | A | | 5/1986 | Hor et al. |
| 4,664,995 | A | | 5/1987 | Horgan et al. |
| 4,921,773 | A | | 5/1990 | Melnyk et al. |
| 5,069,993 | A | | 12/1991 | Robinette et al. |
| 5,204,202 | A | * | 4/1993 | Ishikawa et al. ..... 430/66 |
| 5,215,839 | A | | 6/1993 | Yu |
| 5,660,961 | A | | 8/1997 | Yu |
| 5,756,245 | A | | 5/1998 | Esteghamatian et al. |
| 5,958,638 | A | | 9/1999 | Katayama et al. |
| 2006/0285897 | A1 | * | 12/2006 | Sugiura et al. ..... 399/346 |
| 2008/0124637 | A1 | * | 5/2008 | Uematsu et al. ..... 430/56 |
| 2008/0160438 | A1 | * | 7/2008 | Nishina et al. ..... 430/58.05 |
| 2009/0226828 | A1 | * | 9/2009 | De Jong et al. ..... 430/58.8 |
| 2011/0033798 | A1 | * | 2/2011 | Kim et al. ..... 430/132 |

OTHER PUBLICATIONS

U.S. Appl. No. 12/506,194, filed Jul. 20, 2009 for Woo Soo Kim et al.
U.S. Appl. No. 12/506,175, filed Jul. 20, 2009 for Woo Soo Kim et al.

* cited by examiner

*Primary Examiner* — Jonathan Jelsma
(74) *Attorney, Agent, or Firm* — Pillsbury Winthrop Shaw Pittman LLP

(57) ABSTRACT

The presently disclosed embodiments relate generally to layers that are useful in imaging apparatus members and components, for use in electrophotographic, including digital apparatuses. Embodiments pertain to an improved electrophotographic imaging member used in customer replaceable units (CRU) comprising a very thin outer layer on the imaging member surface, where the outer layer comprises healing materials that act as a barrier against moisture and/or surface contaminants. The improved imaging member exhibits improved xerographic performance, such as reduced wear and deletions in high humidity conditions.

18 Claims, 5 Drawing Sheets

PHOTORECEPTOR OUTER LAYER AND METHODS OF MAKING THE SAME

BACKGROUND

The presently disclosed embodiments relate generally to layers that are useful in imaging apparatus members and components, for use in electrophotographic, including digital, apparatuses. More particularly, the embodiments pertain to an improved electrophotographic imaging member comprising a very thin outer layer on the imaging member surface, where the outer layer comprises healing materials that act as a barrier against moisture and/or surface contaminants. The improved imaging member exhibits improved xerographic performance, such as reduced wear and deletions in high humidity conditions. The embodiments also pertain to methods for making the improved electrophotographic imaging member.

In electrophotographic or electrophotographic printing, the charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as toner. Toner is held on the image areas by the electrostatic charge on the photoreceptor surface. Thus, a toner image is produced in conformity with a light image of the original being reproduced or printed. The toner image may then be transferred to a substrate or support member (e.g., paper) directly or through the use of an intermediate transfer member, and the image affixed thereto to form a permanent record of the image to be reproduced or printed. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

The described electrophotographic copying process is well known and is commonly used for light lens copying of an original document. Analogous processes also exist in other electrophotographic printing applications such as, for example, digital laser printing or ionographic printing and reproduction where charge is deposited on a charge retentive surface in response to electronically generated or stored images.

Scorotron has been employed to charge the surface of a photoreceptor. Alternatively, to charge the surface of a photoreceptor, a contact type charging device has been used. The contact type charging device includes a conductive member which is supplied a voltage from a power source with a D.C. voltage superimposed with a A.C. voltage of no less than twice the level of the D.C. voltage. The charging device contacts the image bearing member (photoreceptor) surface, which is a member to be charged. The outer surface of the image bearing member is charged with the rubbing friction at the contact area. The contact type charging device charges the image bearing member to a predetermined potential. Typically the contact type charger is in the form of a roll charger such as that disclosed in U.S. Pat. No. 4,387,980, the relative portions thereof incorporated herein by reference.

Electrophotographic photoreceptors can be provided in a number of forms. For example, the photoreceptors can be a homogeneous layer of a single material, such as vitreous selenium, or it can be a composite layer containing a photoconductive layer and another material. In addition, the photoreceptor can be layered. Multilayered photoreceptors or imaging members have at least two layers, and may include a substrate, a conductive layer, an optional undercoat layer (sometimes referred to as a "charge blocking layer" or "hole blocking layer"), an optional adhesive layer, a photogenerating layer (sometimes referred to as a "charge generation layer," "charge generating layer," or "charge generator layer"), a charge transport layer, and an optional overcoating layer in either a flexible belt form or a rigid drum configuration. In the multilayer configuration, the active layers of the photoreceptor are the charge generation layer (CGL) and the charge transport layer (CTL). Enhancement of charge transport across these layers provides better photoreceptor performance. Multilayered flexible photoreceptor members may include an anti-curl layer on the backside of the substrate, opposite to the side of the electrically active layers, to render the desired photoreceptor flatness.

Conventional photoreceptors are disclosed in the following patents, a number of which describe the presence of light scattering particles in the undercoat layers: Yu, U.S. Pat. No. 5,660,961; Yu, U.S. Pat. No. 5,215,839; and Katayama et al., U.S. Pat. No. 5,958,638. The term "photoreceptor" or "photoconductor" is generally used interchangeably with the terms "imaging member." The term "electrophotographic" includes "electrophotographic" and "xerographic." The terms "charge transport molecule" are generally used interchangeably with the terms "hole transport molecule."

However, even such conventional photoreceptors are not necessarily sufficient in electrophotographic characteristics and durability, particularly when they are used in combination with a charger of the contact-charging system (contact charger) or a cleaning apparatus, such as a cleaning blade. Further, when a photoreceptor is used in combination with a contact charger and a toner obtained by chemical polymerization (polymerization toner), image quality may be deteriorated due to a surface of the photoreceptor being stained with a discharge product produced in contact charging or the polymerization toner remaining after a transfer step. Still further, the use of a cleaning blade to remove discharge product or remaining toner from the surface of the photoreceptor involves friction and abrasion between the surface of the photoreceptor and the cleaning blade, which tends to damage the surface of the photoreceptor, breaks the cleaning blade or turns up the cleaning blade. As a result of this repetitive cycling, the outermost layer of the photoreceptor experiences a high degree of frictional contact with other machine subsystem components used to clean and/or prepare the photoreceptor for imaging during each cycle. When repeatedly subjected to cyclic mechanical interactions against the machine subsystem components, photoreceptor can experience severe frictional wear at the outermost organic photoreceptor layer surface that can greatly reduce the useful life of the photoreceptor. Ultimately, the resulting wear impairs photoreceptor performance and thus image quality.

Thus, as the demand for improved print quality in xerographic reproduction is increasing, there is a continued need for achieving improved performance, such as finding a way to minimize or eliminate charge accumulation in photoreceptors.

SUMMARY

According to aspects illustrated herein, there is provided a xerographic image forming apparatus comprising: a) an imaging member having a charge retentive-surface for developing an electrostatic latent image thereon, wherein the imaging member comprises: a substrate, and a photoconductive member disposed on the substrate, b) a holding member for holding a source of healing material, and c) a delivery member for delivering the healing material from the holding member onto a surface of the imaging member, comprising a substrate and an elastic outer layer disposed on the substrate, wherein a surface of the elastic outer layer has a surface pattern comprising an array of periodically ordered indentations or protrusions on the surface of the elastic outer layer.

In another embodiment, there is provided a xerographic image forming system comprising: a) a photoreceptor having a charge retentive-surface for developing an electrostatic latent image thereon, wherein the photoreceptor comprises a substrate, a charge generating layer disposed on the substrate, at least one charge transport layer disposed on the charge generating layer, and optionally an overcoat layer disposed on the charge transport layer; b) a holding member for holding a source of healing material; c) a delivery member for delivering the healing material from the holding member onto a surface of the photoreceptor, comprising a substrate and an elastic outer layer disposed on the substrate, wherein a surface of the elastic outer layer has a pattern comprising an array of periodically ordered indentations or protrusions on the surface of the elastic outer layer; d) a charging and exposure unit for developing an electrostatic image on the photoreceptor surface; e) a toner developer component for applying a developer material to the charge-retentive surface of the photoreceptor to form a developed image on the charge-retentive surface; f) a transfer component for transferring the developed image from the charge-retentive surface to a copy substrate; and g) a cleaning component for cleaning remaining toner particles.

In yet further embodiments, there is provided an image forming method for xerographic image forming system comprising: providing the above-described xerographic image forming system; applying a healing material onto the surface of the photoreceptor surface through the delivery member; developing an electrostatic image on the photoreceptor surface containing healing material through charging and exposure unit; developing a toner image onto the photoreceptor surface through the toner developer component; transferring the toner image to a printing substrate through the transfer component; and removing residual toner material from the photoreceptor through the cleaning component.

BRIEF DESCRIPTION OF THE DRAWINGS

For a better understanding, reference may be made to the accompanying figures.

DETAILED DESCRIPTION

Figure 1:
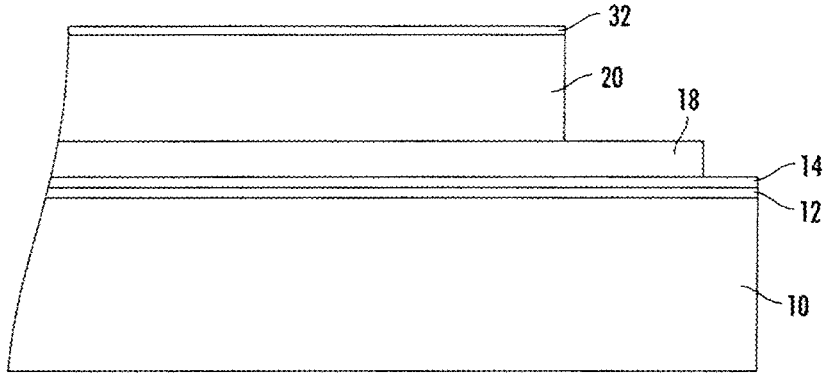
FIG. 1 is a cross-sectional view of an imaging member in a drum configuration according to the present embodiments.

In the following description, reference is made to the accompanying drawings, which form a part hereof and which illustrate several embodiments. It is understood that other embodiments may be used and structural and operational changes may be made without departure from the scope of the present disclosure.

The disclosed embodiments are directed generally to an improved electrophotographic imaging member comprising a very thin outer layer on the imaging member surface that comprises healing materials that act as a barrier against moisture and/or surface contaminants. The outer layer imparts improved xerographic performance to imaging members incorporating such an outer layer, such as improved wear resistance, low friction, and reduced image defects due to deletion in high humidity conditions. The embodiments also pertain to methods for making the improved electrophotographic imaging member using a delivery member for delivering the healing materials to the outer layer of an imaging surface. In the present embodiments, the delivery member is a stamp roll implemented in photoreceptor cartridge, such as a customer replaceable unit (CRU) of a xerographic printing system such that the stamp roll delivers healing materials to the outer layer, for example, an overcoat layer, of a photoreceptor.

The exemplary embodiments of this disclosure are described below with reference to the drawings. The specific terms are used in the following description for clarity, selected for illustration in the drawings and not to define or limit the scope of the disclosure. The same reference numerals are used to identify the same structure in different figures unless specified otherwise. The structures in the figures are not drawn according to their relative proportions and the drawings should not be interpreted as limiting the disclosure in size, relative size, or location. In addition, though the discussion will address negatively charged systems, the imaging members of the present disclosure may also be used in positively charged systems.

FIG. 1 is an exemplary embodiment of a multilayered electrophotographic imaging member having a drum configuration. The substrate may further be in a cylinder configuration. As can be seen, the exemplary imaging member includes a rigid support substrate 10, an electrically conductive ground plane 12, an undercoat layer 14, a charge generation layer 18 and a charge transport layer 20. The rigid substrate may be comprised of a material selected from the group consisting of a metal, metal alloy, aluminum, zirconium, niobium, tantalum, vanadium, hafnium, titanium, nickel, stainless steel, chromium, tungsten, molybdenum, and mixtures thereof. The substrate may also comprise a material selected from the group consisting of a metal, a polymer, a glass, a ceramic, and wood.

The charge generation layer 18 and the charge transport layer 20 forms an imaging layer described here as two separate layers. In an alternative to what is shown in the figure, the charge generation layer may also be disposed on top of the charge transport layer. It will be appreciated that the functional components of these layers may alternatively be combined into a single layer.

Figure 2:
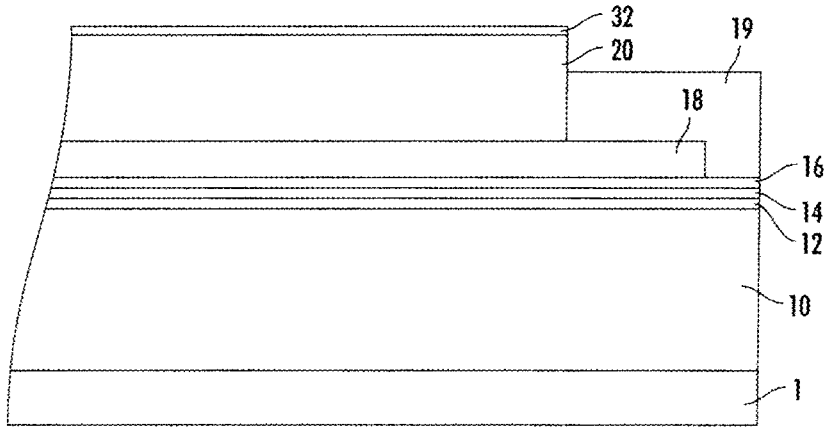
FIG. 2 is a cross-sectional view of an imaging member in a belt configuration according to the present embodiments.

FIG. 2 shows an imaging member having a belt configuration according to the embodiments. As shown, the belt configuration is provided with an anti-curl back coating 1, a supporting substrate 10, an electrically conductive ground plane 12, an undercoat layer 14, an adhesive layer 16, a charge generation layer 18, and a charge transport layer 20. An optional overcoat layer 32 and ground strip 19 may also be included. An exemplary photoreceptor having a belt configuration is disclosed in U.S. Pat. No. 5,069,993, which is hereby incorporated by reference.

As discussed above, an electrophotographic imaging member generally comprises at least a substrate layer, an imaging layer disposed on the substrate and an optional overcoat layer disposed on the imaging layer. In further embodiments, the imaging layer comprises a charge generation layer disposed on the substrate and the charge transport layer disposed on the charge generation layer. In other embodiments, an undercoat layer may be included and is generally located between the substrate and the imaging layer, although additional layers may be present and located between these layers. The imaging member may also include anticurl back coating layer in certain embodiments. The imaging member can be employed in the imaging process of electrophotography, where the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. The radiation selectively dissipates the charge on the illuminated areas of the photoconductive insulating layer while leaving behind an electrostatic latent image. This electrostatic latent image may then be developed to form a visible image by depositing charged particles of same or opposite polarity on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

Common print quality issues are strongly dependent on the quality and interaction of these photoreceptor layers. For example, when a photoreceptor is used in combination with a contact charger and a toner obtained by chemical polymerization (polymerization toner), image quality may be deteriorated due to a surface of the photoreceptor being stained with a discharge product produced in contact charging or the polymerization toner remaining after a transfer step. Still further, the use of a cleaning blade to remove discharge product or remaining toner from the surface of the photoreceptor involves friction and abrasion between the surface of the photoreceptor and the cleaning blade, which tends to damage the surface of the photoreceptor, breaks the cleaning blade or turns up the cleaning blade. As a result of this repetitive cycling, the outermost layer of the photoreceptor experiences a high degree of frictional contact with other machine subsystem components used to clean and/or prepare the photoreceptor for imaging during each cycle. When repeatedly subjected to cyclic mechanical interactions against the machine subsystem components, photoreceptor belts can experience severe frictional wear at the outermost organic photoreceptor layer surface that can greatly reduce the useful life of the photoreceptor. Ultimately, the resulting wear impairs photoreceptor performance and thus image quality. Another type of common image defects is thought to result from the accumulation of charge somewhere in the photoreceptor. Consequently, when a sequential image is printed, the accumulated charge results in image density changes in the current printed image that reveals the previously printed image. In the xerographic process spatially varying amounts of positive charges from the transfer station find themselves on the photoreceptor surface. If this variation is large enough it will manifest itself as a variation in the image potential in the following xerographic cycle and print out as a defect.

The present embodiments, employ delivery members to deliver an ultra thin layer of healing materials onto the photoreceptor surface to act as a barrier against moisture and surface contaminants and improve xerographic performance in high humidity conditions, such as for example, A-zone environment.

Long life photoreceptors enable a significant run-cost reduction. A conventional approach to photoreceptor life extension is to apply an overcoat layer with wear resistance. While this approach works for scorotron charging systems, it suffers drawbacks in other systems. For bias charge roller (BCR) charging systems, overcoat layers are associated with a trade-off between A-zone deletions and photoreceptor wear rate. For example, most organic photo conductor (OPC) materials sets require a certain wear rate in order to suppress A-zone deletions. As a result, the life of a photoreceptor is typically limited to, for example, around 1 million cycles. The present embodiments, however, have demonstrated a decrease in both wear rate and deletions. The present embodiments provide photoreceptor technology for BCR charging systems with a life target of over one million cycles.

In embodiments, there is provided a method for controlled delivery of healing materials onto the surface of a photoreceptor by continuous delivery of healing material to provide an ultra thin nano-scale layer of barrier against moisture and surface contaminants and improve xerographic performance in high humidity conditions (A-zone). From prior mechanistic studies, it has been demonstrated that A-zone deletion is caused by a number of occurrences, including, high energy charging by the BCR which results in the formation of hydrophilic chemical species (e.g., —OH, —COOH) on the photoreceptor surface, water being physically absorbed on the hydrophilic photoreceptor surface in humid environment, and an increase in the surface conductivity of the photoreceptor due to the absorbed water layer and toner contaminants. Thus, to address these issues, the present embodiments disclose a controlled delivery of an ultra thin layer of healing material that can be applied directly to the photoreceptor surface continuously and is capable of preventing A-zone deletion for low wear photoreceptors.

A healing material is a material that has ability to partially repair physical and chemical damage occurring during its service life time. Usually, certain properties of any engineering material degrade over time due to environmental conditions or fatigue, or due to damage incurred during operation. Such damage is often on a microscopic scale, requiring periodic inspection and repair to avoid growing damage that may cause operational failure. Healing materials may be used to address this degradation by responding to the micro-damage. Healing materials can be a kind of organic monomer or polymer optionally further containing a catalyst or encapsulated in nano- or micro-capsules. In another embodiment, the healing material described herein can also include a material capable of retaining surface properties of, for example a photoreceptor layer. In this case, the healing material may be physically absorbed on the surface or chemically bonding with certain chemical species on the surface. The healing materials can be a kind of an organic or inorganic compound, a monomer or polymer, or a mixture thereof. The healing materials may be in the form of liquid, wax, or gel.

In specific embodiments, the delivery member 34 comprises a substrate, and an elastic outer layer 32 disposed on the substrate, wherein a surface of the elastic outer layer has a pattern comprising an array of periodically ordered indentations or protrusions on the surface of the elastic outer layer. The elastic outer layer may have a thickness of from about 50 nanometer to about 1000 microns. A roll-to-roll method may be used to continuously deliver healing materials onto the photoreceptor surface during a whole machine lifetime. In such an embodiment, the elastic outer layer 32 is configured into a roll 34 which is constantly supplied by a source of the healing material via a sponge or other like structure. In turn, the elastic outer layer roll 34 continuously contacts the surface of the photoreceptor such that the ultra thin layer of healing material is applied over the overcoat layer. Healing materials may comprise, in particular embodiments, a hydrophobic or oleophobic material. For example, hydrophobic or oleophobic materials comprising alkylalkoxysilanes, organic monomers or polymers, optionally containing a catalyst, polymeric or inorganic particles, and the like, provide dramatically reduced A-zone deletion and other printing defects. Such embodiments have shown to be deletion free in A-zone while maintaining good electrical performance. Moreover, the amount of delivered materials can be controlled by the density of the pattern on the elastic outer layer. The denser the pattern on the elastic outer layer, the lesser the amount of delivered materials is absorbed and applied to the photoreceptor.

Figure 3:
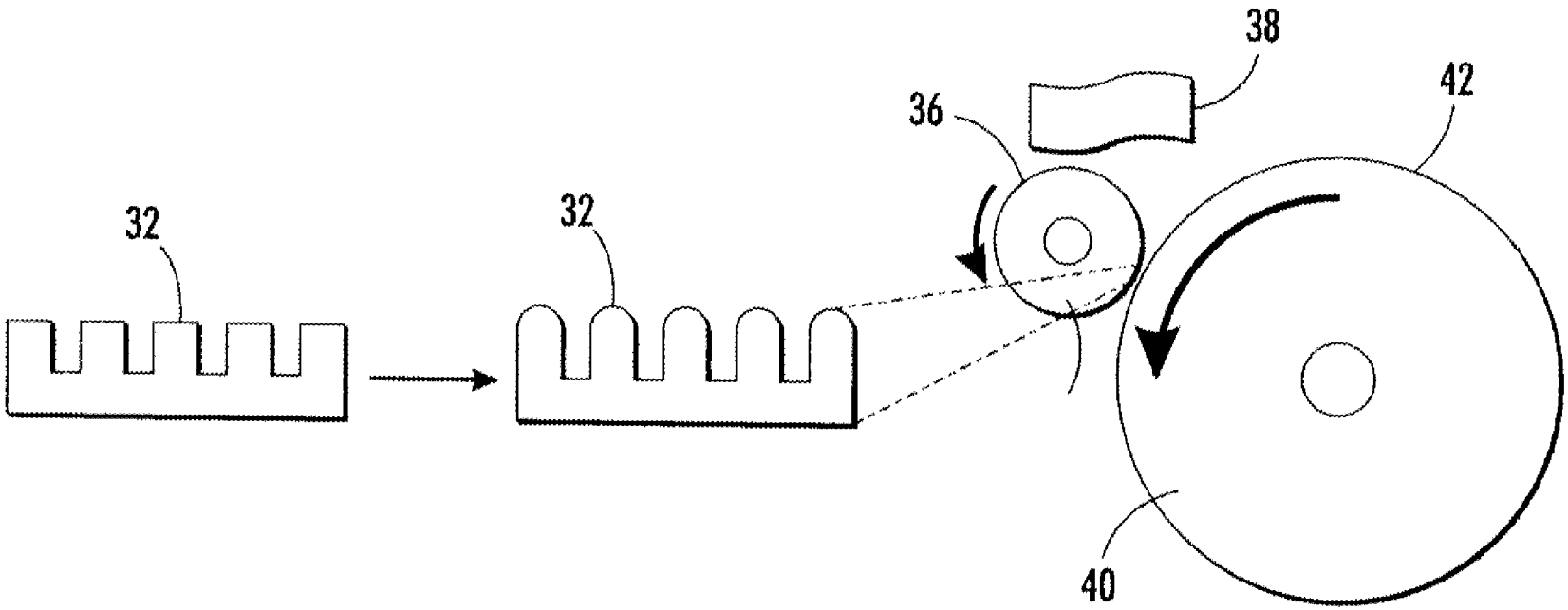
FIG. 3 is an illustration showing a method for making an outer layer of an imaging member according to the present embodiments.

In FIG. 3, there is illustrated a method for forming an outer layer of a photoreceptor. As shown, the method comprises providing a delivery member 34, such as for example, a delivery member 34, for delivery of a healing material 36. The delivery member or elastic outer layer 32 may be fabricated by printing a pattern on a nano- or micron-scale on a substrate to produce a master pattern, and curing a flexible material onto the master pattern to form the elastic outer layer 32. Such method of fabrication is disclosed in commonly owned and co-pending U.S. patent application Ser. No. 12/506,194 to Kim et al., and commonly owned and co-pending U.S. patent application Ser. No. 12/506,175 to Kim et al., the entire disclosures of which are incorporated herein by reference in its entirety. The healing material 36 is continuously applied to the delivery member 34, in specific embodiments, by a sponge 38. A photoreceptor 40 comprising a substrate, an imaging layer disposed over the substrate, and an overcoat disposed over the imaging layer is provided and the healing material 36 is delivered from the delivery member 34 to the surface of the photoreceptor 40, for example, to the surface of an overcoat layer. The elastic outer layer 32 contacts the surface of the overcoat layer to form an outer layer 42, wherein a photoreceptor having the outer layer 42 exhibits both reduced wear rate and reduced ghosting as compared to a photoreceptor without the outer layer.

The elastic outer layer 32, in embodiments, comprises a regularly patterned surface and further wherein the surface pattern comprises an array of periodically ordered indentations or protrusions in a surface of the elastic outer layer. In embodiments, the surface pattern may include an array of periodically ordered indentations having a depth of from about 3 nanometers to about 12 microns, or from about 10 nanometers to about 5 microns, or from about 50 nanometers to about 5 microns. In embodiments, the surface pattern comprises an array of periodically ordered indentations having a diameter of from about 3 nanometers to about 100 microns, or from about 10 nanometers to about 100 microns. In other embodiments, the an array of periodically ordered indentations have a center-to-center distance of from about 3 nanometers to about 500 microns, or from about 10 nanometers to about 100 microns. The surface pattern may include periodically ordered indentations being of equidistance from one another in an evenly distributed pattern across the surface of the overcoat layer of the photoreceptor and forming a uniform pattern on the surface of the photoreceptor. The periodically ordered indentations may be in the shape of circles, rods, squares, triangles, polygons, mixtures thereof, and the like. Alternative patterns may include periodic or non-periodic hole arrays, two-dimensional crystalline hexagonal patterns, rectangular arrays of patterns or quasi-crystalline array of patterns.

In addition, when the surface pattern comprises an array of periodically ordered protrusions or bumps, these bumps may likewise be in the shape of circles, rods, squares, triangles, polygons, mixtures thereof and the like. The dimensions would remain the same as discussed for the indentations, however, the dimension for depth will be reversed to a dimension for height. Thus, the protrusions may have a height of from about 3 nanometers to about 12 microns, or from about 10 nanometers to about 5 microns, or from about 50 nanometers to about 5 microns. The methods for making the protrusions would likewise comprise the same steps as discussed for the indentations, but the shapes (e.g., indentations or protrusions) of the master pattern and elastic outer layer would be reversed accordingly.

The substrate used for the master pattern may be selected from the group consisting of polyethylene terephtalate, silicon, glass, MYLAR, plastics, mixtures thereof, and the like. The flexible material may be selected from the group consisting of polysiloxane, polyurethane, polyester, and mixtures thereof. In FIG. 3, the method of contacting the elastic outer layer to the surface of the overcoat layer to form an outer layer is performed via a roll-ro-roll configuration, however, other known methods may also be suitable, such as for example, web processing or reel-to-reel processing.

In further embodiments, there is provided a photoreceptor made by the presently disclosed methods. For example, there is provided a photoreceptor comprising a substrate, an imaging layer disposed on the substrate, an overcoat layer disposed on the imaging layer, and an outer layer disposed on the overcoat layer, wherein the outer layer is formed by delivering a healing material to a surface of the overcoat layer, and further wherein the photoreceptor exhibits both reduced wear rate and reduced ghosting as compared to a photoreceptor without the outer layer. As discussed above, the healing material is delivered to the surface of the overcoat by contacting an elastic outer layer applied with the healing material to the surface of the overcoat layer. In embodiments, the outer layer may be applied directly to the imaging layer in place of the overcoat layer. In embodiments, the elastic outer layer comprises a regularly patterned surface and further wherein the surface pattern comprises an array of periodically ordered indentations or protrusions in a surface of the elastic outer layer. In the present embodiments, the lubricant may be present in the outer layer in an amount of from about 0 to about 50 percent by weight of the outer layer, or from about 0 to about 30 percent by weight of the outer layer, or from about 0 to about 25 percent by weight of the outer layer. In embodiments, the lubricant material may be selected from the group consisting of paraffin, alkyl alkoxy-silanes, organic monomers with catalytic particles or microcapsules, organic polymers with catalytic particles, microcapsules, and mixtures thereof.

In embodiments, the amount of healing material delivered onto the photoreceptor surface should be sufficient to retain the photoreceptor performance properties. The healing material can be present on the photoreceptor surface at various amount, for example, at a molecular level, or in an amount of from $1\times10^{-7}$ to $1\times10^{-2}$ mg per square inch. The outer layer may have a thickness of from about 0.5 nanometer to about 10 microns, or from about 1 nanometer to about 5 microns, or from about 1 nanometer to about 2 microns. The present embodiments provide a photoreceptor that exhibits both reduced wear rate and reduced ghosting as compared to a photoreceptor without the outer layer.

Figure 4A:
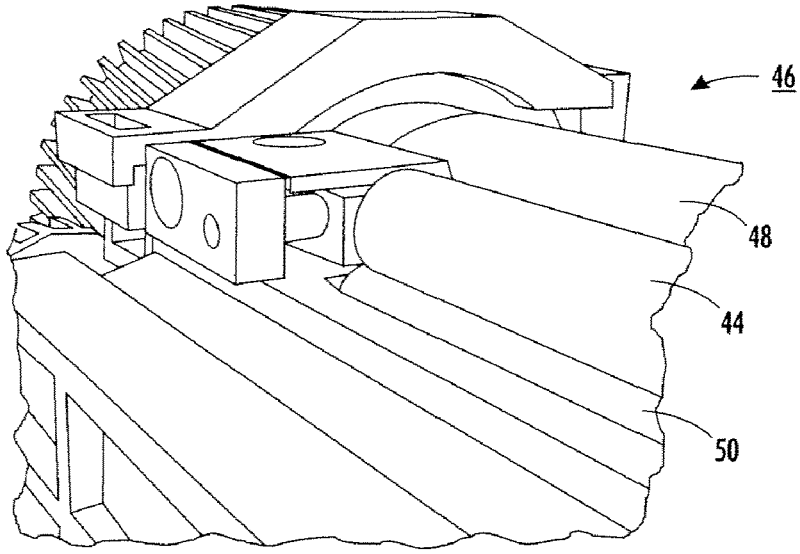
FIG. 4A is an external view of a system implementing a delivery member in a customer replaceable unit (CRU) according to the present embodiments.
Figure 4B:
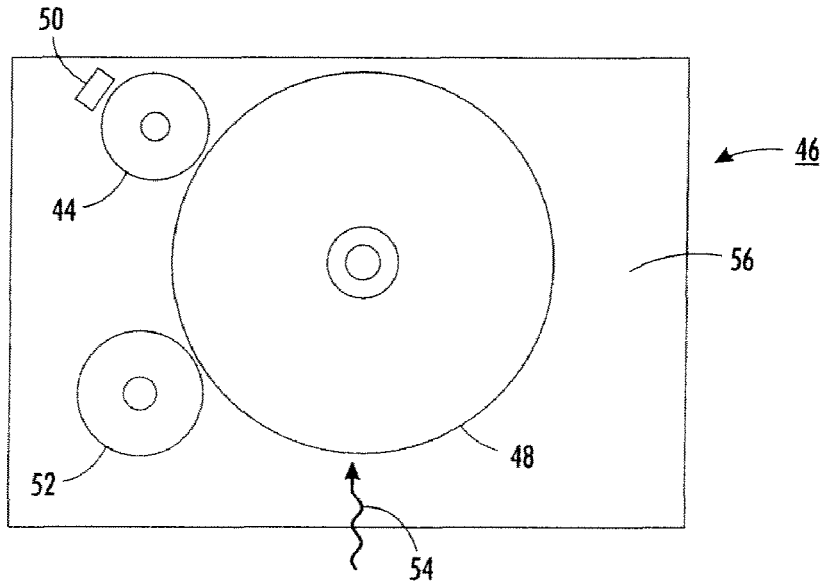
FIG. 4B is a cross-sectional view of a system implementing a delivery member in a customer replaceable unit (CRU) according to the present embodiments.

In the present embodiments, the delivery member is a stamp roll 44 in a xerographic printing system 46. As shown in FIG. 4A, the stamp roll is implemented as a CRU in the printing system 46 and facilitates continuous delivery of healing materials to a photoreceptor 48 contained in the xerographic printing system 46. In such embodiments, the healing material is contained in a holder 50 which in turn provides the healing material to the stamp roll 44. In embodiments, the healing material holder 50 is a sponge containing the healing materials. FIG. 4B, depicts a cross-sectional view of the printing system 46. As can be seen, as the overcoated photoreceptor drum 48 rotates, the stamp roll 44 obtains healing materials from the healing material holder 50, for example, a sponge, and delivers the healing materials to the surface of the overcoated photoreceptor 48. Subsequently, the photoreceptor 48 is substantially uniformally charged by the bias charge roller 52 to initiate the electrophotographic reproduction process. The charged photoreceptor is then exposed to a light image 54 to create an electrostatic latent image on the photoreceptive member. This latent image is subsequently developed into a visible image by a process in which a charged developing material is deposited onto the photoconductive surface layer 56, such that the developing material is attracted to the charged image areas on the photoreceptive member. Thereafter, the developing material is transferred from the photoreceptive member to a copy sheet or some other image support substrate to which the image may be permanently affixed for producing a reproduction of the original document. The photoreceptor surface is generally then cleaned to remove any residual developing material therefrom, in preparation for successive imaging cycles.

The Overcoat Layer

Other layers of the imaging member may include, for example, an optional over coat layer 32. An optional overcoat layer 32, if desired, may be disposed over the charge transport layer 20 to provide imaging member surface protection as well as improve resistance to abrasion. In embodiments, the overcoat layer 32 may have a thickness ranging from about 0.1 micrometer to about 10 micrometers or from about 1 micrometer to about 10 micrometers, or in a specific embodiment, about 3 micrometers. These overcoating layers may include thermoplastic organic polymers or inorganic polymers that are electrically insulating or slightly semi-conductive. For example, overcoat layers may be fabricated from a dispersion including a particulate additive in a resin. Suitable particulate additives for overcoat layers include metal oxides including aluminum oxide, non-metal oxides including silica or low surface energy polytetrafluoroethylene (PTFE), and combinations thereof. Suitable resins include those described above as suitable for photogenerating layers and/or charge transport layers, for example, polyvinyl acetates, polyvinylbutyrals, polyvinylchlorides, vinylchloride and vinyl acetate copolymers, carboxyl-modified vinyl chloride/vinyl acetate copolymers, hydroxyl-modified vinyl chloride/vinyl acetate copolymers, carboxyl- and hydroxyl-modified vinyl chloride/vinyl acetate copolymers, polyvinyl alcohols, polycarbonates, polyesters, polyurethanes, polystyrenes, polybutadienes, polysulfones, polyarylethers, polyarylsulfones, polyethersulfones, polyethylenes, polypropylenes, polymethylpentenes, polyphenylene sulfides, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly-N-vinylpyrrolidinones, acrylate copolymers, alkyd resins, cellulosic film formers, poly (amideimide), styrene-butadiene copolymers, vinylidenechloride-vinylchloride copolymers, vinylacetate-vinylidenechloride copolymers, styrene-alkyd resins, polyvinylcarbazoles, and combinations thereof. Overcoating layers may be continuous and have a thickness of at least about 0.5 micrometer, or no more than 10 micrometers, and in further embodiments have a thickness of at least about 2 micrometers, or no more than 6 micrometers.

In specific embodiments, the overcoat layer is imprinted on its surface with a nano- to micron-scale pattern. The imprinted surface offers numerous unexpected benefits such as, for example, lower friction with the cleaning blade, improved print quality and smoother interaction to minimize blade damage, and consequently longer service life.

The Substrate

The photoreceptor support substrate 10 may be opaque or substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed, such as for example, metal or metal alloy. Electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, niobium, stainless steel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be single metallic compound or dual layers of different metals and/or oxides.

The substrate 10 can also be formulated entirely of an electrically conductive material, or it can be an insulating material including inorganic or organic polymeric materials, such as MYLAR, a commercially available biaxially oriented polyethylene terephthalate from DuPont, or polyethylene naphthalate available as KALEDEX 2000, with a ground plane layer 12 comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations.

The substrate 10 may have a number of many different configurations, such as for example, a plate, a cylinder, a drum, a scroll, an endless flexible belt, and the like. In the case of the substrate being in the form of a belt, as shown in FIG. 2, the belt can be seamed or seamless. In embodiments, the photoreceptor herein is in a drum configuration.

The thickness of the substrate 10 depends on numerous factors, including flexibility, mechanical performance, and economic considerations. The thickness of the support substrate 10 of the present embodiments may be at least about 500 micrometers, or no more than about 3,000 micrometers, or be at least about 750 micrometers, or no more than about 2500 micrometers.

An exemplary substrate support 10 is not soluble in any of the solvents used in each coating layer solution, is optically transparent or semi-transparent, and is thermally stable up to a high temperature of about 150° C. A substrate support 10 used for imaging member fabrication may have a thermal contraction coefficient ranging from about $1\times10^{-5}$ per ° C. to about $3\times10^{-5}$ per ° C. and a Young's Modulus of between about $5\times10^{-5}$ psi ($3.5\times10^{-4}$ Kg/cm$^2$) and about $7\times10^{-5}$ psi ($4.9\times10^{-4}$ Kg/cm$^2$).

The Ground Plane

The electrically conductive ground plane 12 may be an electrically conductive metal layer which may be formed, for example, on the substrate 10 by any suitable coating technique, such as a vacuum depositing technique. Metals include aluminum, zirconium, niobium, tantalum, vanadium, hafnium, titanium, nickel, stainless steel, chromium, tungsten, molybdenum, and other conductive substances, and mixtures thereof. The conductive layer may vary in thickness over substantially wide ranges depending on the optical transparency and flexibility desired for the electrophotoconductive member. Accordingly, for a flexible photoresponsive imaging device, the thickness of the conductive layer may be at least about 20 Angstroms, or no more than about 750 Angstroms, or at least about 50 Angstroms, or no more than about 200 Angstroms for an optimum combination of electrical conductivity, flexibility and light transmission.

Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as transparent layer for light having a wavelength between about 4000 Angstroms and about 9000 Angstroms or a conductive carbon black dispersed in a polymeric binder as an opaque conductive layer.

The Hole Blocking Layer

After deposition of the electrically conductive ground plane layer, the hole blocking layer 14 may be applied thereto. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized. The hole blocking layer may include polymers such as polyvinylbutryral, epoxy resins, polyesters, polysiloxanes, polyamides, polyurethanes and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl)gamma-amino-propyl trimethoxy silane, isopropyl 4-aminobenzene sulfonyl, di(dodecylbenzene sulfonyl)titanate, isopropyl di(4-aminobenzoyl)isostearoyl titanate, isopropyl tri(N-ethylamino-ethylamino)titanate, isopropyl trianthranil titanate, isopropyl tri(N,N-dimethyl-ethylamino)titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl)methyl diethoxysilane, as disclosed in U.S. Pat. Nos. 4,338,387, 4,286,033 and 4,291,110.

General embodiments of the undercoat layer may comprise a metal oxide and a resin binder. The metal oxides that can be used with the embodiments herein include, but are not limited to, titanium oxide, zinc oxide, tin oxide, aluminum oxide, silicon oxide, zirconium oxide, indium oxide, molybdenum oxide, and mixtures thereof. Undercoat layer binder materials may include, for example, polyesters, MOR-ESTER 49,000 from Morton International Inc., VITEL PE-100, VITEL PE-200, VITEL PE-200D, and VITEL PE-222 from Goodyear Tire and Rubber Co., polyarylates such as ARDEL from AMOCO Production Products, polysulfone from AMOCO Production Products, polyurethanes, and the like.

The hole blocking layer should be continuous and have a thickness of less than about 0.5 micrometer because greater thicknesses may lead to undesirably high residual voltage. A hole blocking layer of between about 0.005 micrometer and about 0.3 micrometer is used because charge neutralization after the exposure step is facilitated and optimum electrical performance is achieved. A thickness of between about 0.03 micrometer and about 0.06 micrometer is used for hole blocking layers for optimum electrical behavior. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is applied in the form of a dilute solution, with the solvent being removed after deposition of the coating by conventional techniques such as by vacuum, heating and the like. Generally, a weight ratio of hole blocking layer material and solvent of between about 0.05:100 to about 0.5:100 is satisfactory for spray coating.

The Charge Generation Layer

The charge generation layer 18 may thereafter be applied to the undercoat layer 14. Any suitable charge generation binder including a charge generating/photoconductive material, which may be in the form of particles and dispersed in a film forming binder, such as an inactive resin, may be utilized. Examples of charge generating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, enzimidazole perylene, and the like, and mixtures thereof, dispersed in a film forming polymeric binder. Selenium, selenium alloy, benzimidazole perylene, and the like and mixtures thereof may be formed as a continuous, homogeneous charge generation layer. Benzimidazole perylene compositions are well known and described, for example, in U.S. Pat. No. 4,587,189, the entire disclosure thereof being incorporated herein by reference. Multi-charge generation layer compositions may be used where a photoconductive layer enhances or reduces the properties of the charge generation layer. Other suitable charge generating materials known in the art may also be utilized, if desired. The charge generating materials selected should be sensitive to activating radiation having a wavelength between about 400 and about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

Any suitable inactive resin materials may be employed as a binder in the charge generation layer 18, including those described, for example, in U.S. Pat. No. 3,121,006, the entire disclosure thereof being incorporated herein by reference. Organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like. Another film-forming polymer binder is PCZ-400 (poly (4,4'-dihydroxy-diphenyl-1-1-cyclohexane) which has a viscosity-molecular weight of 40,000 and is available from Mitsubishi Gas Chemical Corporation (Tokyo, Japan).

The charge generating material can be present in the resinous binder composition in various amounts. Generally, at least about 5 percent by volume, or no more than about 90 percent by volume of the charge generating material is dispersed in at least about 95 percent by volume, or no more than about 10 percent by volume of the resinous binder, and more specifically at least about 20 percent, or no more than about 60 percent by volume of the charge generating material is dispersed in at least about 80 percent by volume, or no more than about 40 percent by volume of the resinous binder composition.

In specific embodiments, the charge generation layer 18 may have a thickness of at least about 0.1 μm, or no more than about 2 μm, or of at least about 0.2 μm, or no more than about 1 μm. These embodiments may be comprised of chlorogallium phthalocyanine or hydroxygallium phthalocyanine or mixtures thereof. The charge generation layer 18 containing the charge generating material and the resinous binder material generally ranges in thickness of at least about 0.1 μm, or no more than about 5 μm, for example, from about 0.2 μm to about 3 μm when dry. The charge generation layer thickness is generally related to binder content. Higher binder content compositions generally employ thicker layers for charge generation.

The Charge Transport Layer

In a drum photoreceptor, the charge transport layer comprises a single layer of the same composition. As such, the charge transport layer will be discussed specifically in terms of a single layer 20, but the details will be also applicable to an embodiment having dual charge transport layers. The charge transport layer 20 is thereafter applied over the charge generation layer 18 and may include any suitable transparent organic polymer or non-polymeric material capable of supporting the injection of photogenerated holes or electrons from the charge generation layer 18 and capable of allowing the transport of these holes/electrons through the charge transport layer to selectively discharge the surface charge on the imaging member surface. In one embodiment, the charge transport layer 20 not only serves to transport holes, but also protects the charge generation layer 18 from abrasion or chemical attack and may therefore extend the service life of the imaging member. The charge transport layer 20 can be a substantially non-photoconductive material, but one which supports the injection of photogenerated holes from the charge generation layer 18.

The layer 20 is normally transparent in a wavelength region in which the electrophotographic imaging member is to be used when exposure is affected there to ensure that most of the incident radiation is utilized by the underlying charge generation layer 18. The charge transport layer should exhibit excellent optical transparency with negligible light absorption and no charge generation when exposed to a wavelength of light useful in xerography, e.g., 400 to 900 nanometers. In the case when the photoreceptor is prepared with the use of a transparent substrate 10 and also a transparent or partially transparent conductive layer 12, image wise exposure or erase may be accomplished through the substrate 10 with all light passing through the back side of the substrate. In this case, the materials of the layer 20 need not transmit light in the wavelength region of use if the charge generation layer 18 is sandwiched between the substrate and the charge transport layer 20. The charge transport layer 20 in conjunction with the charge generation layer 18 is an insulator to the extent that an electrostatic charge placed on the charge transport layer is not conducted in the absence of illumination. The charge transport layer 20 should trap minimal charges as the charge passes through it during the discharging process.

The charge transport layer 20 may include any suitable charge transport component or activating compound useful as an additive dissolved or molecularly dispersed in an electrically inactive polymeric material, such as a polycarbonate binder, to form a solid solution and thereby making this material electrically active. "Dissolved" refers, for example, to forming a solution in which the small molecule is dissolved in the polymer to form a homogeneous phase; and molecularly dispersed in embodiments refers, for example, to charge transporting molecules dispersed in the polymer, the small molecules being dispersed in the polymer on a molecular scale. The charge transport component may be added to a film forming polymeric material which is otherwise incapable of supporting the injection of photogenerated holes from the charge generation material and incapable of allowing the transport of these holes through. This addition converts the electrically inactive polymeric material to a material capable of supporting the injection of photogenerated holes from the charge generation layer 18 and capable of allowing the transport of these holes through the charge transport layer 20 in order to discharge the surface charge on the charge transport layer. The high mobility charge transport component may comprise small molecules of an organic compound which cooperate to transport charge between molecules and ultimately to the surface of the charge transport layer. For example, but not limited to, N,N'-diphenyl-N,N-bis(3-methyl phenyl)-1,1'-biphenyl-4,4'-diamine (TPD), other arylamines like triphenyl amine, N,N,N',N'-tetra-p-tolyl-1,1'-biphenyl-4,4'-diamine (TM-TPD), and the like.

A number of charge transport compounds can be included in the charge transport layer, which layer generally is of a thickness of from about 5 to about 75 micrometers, and more specifically, of a thickness of from about 15 to about 40 micrometers. Examples of charge transport components are aryl amines of the following formulas/structures:

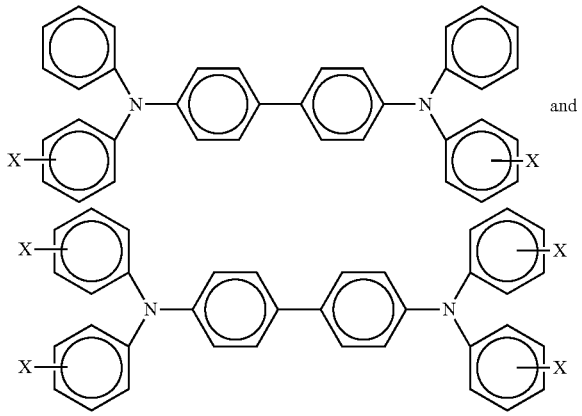

and wherein X is a suitable hydrocarbon like alkyl, alkoxy, aryl, and derivatives thereof; a halogen, or mixtures thereof, and especially those substituents selected from the group consisting of Cl and $CH_3$; and molecules of the following formulas

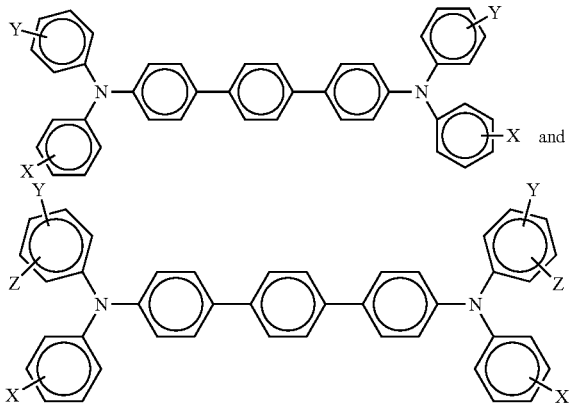

and wherein X, Y and Z are independently alkyl, alkoxy, aryl, a halogen, or mixtures thereof, and wherein at least one of Y and Z are present.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific aryl amines that can be selected for the charge transport layer include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules may be selected in embodiments, reference for example, U.S. Pat. Nos. 4,921,773 and 4,464,450, the disclosures of which are totally incorporated herein by reference.

Examples of the binder materials selected for the charge transport layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), and epoxies, and random or alternating copolymers thereof. In embodiments, the charge transport layer, such as a hole transport layer, may have a thickness of at least about 10 μm, or no more than about 40 μm.

Examples of components or materials optionally incorporated into the charge transport layers or at least one charge transport layer to, for example, enable improved lateral charge migration (LCM) resistance include hindered phenolic antioxidants such as tetrakis methylene(3,5-di-tert-butyl-4-hydroxy hydrocinnamate)methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SANKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER® TPS (available from Sumitomo Chemical Co., Ltd.); thioether antioxidants such as SUMILIZER® TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl) phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layer is from about 0 to about 20, from about 1 to about 10, or from about 3 to about 8 weight percent.

The charge transport layer should be an insulator to the extent that the electrostatic charge placed on the hole transport layer is not conducted in the absence of illumination at a rate sufficient to prevent formation and retention of an electrostatic latent image thereon. The charge transport layer is substantially nonabsorbing to visible light or radiation in the region of intended use, but is electrically "active" in that it allows the injection of photogenerated holes from the photoconductive layer, that is the charge generation layer, and allows these holes to be transported through itself to selectively discharge a surface charge on the surface of the active layer.

In addition, in the present embodiments using a belt configuration, the charge transport layer may consist of a single pass charge transport layer or a dual pass charge transport layer (or dual layer charge transport layer) with the same or different transport molecule ratios. In these embodiments, the dual layer charge transport layer has a total thickness of from about 10 μm to about 40 μm. In other embodiments, each layer of the dual layer charge transport layer may have an individual thickness of from 2 μm to about 20 μm. Moreover, the charge transport layer may be configured such that it is used as a top layer of the photoreceptor to inhibit crystallization at the interface of the charge transport layer and the overcoat layer. In another embodiment, the charge transport layer may be configured such that it is used as a first pass charge transport layer to inhibit microcrystallization occurring at the interface between the first pass and second pass layers.

Any suitable and conventional technique may be utilized to form and thereafter apply the charge transport layer mixture to the supporting substrate layer. The charge transport layer may be formed in a single coating step or in multiple coating steps. Dip coating, ring coating, spray, gravure or any other drum coating methods may be used.

Drying of the deposited coating may be effected by any suitable conventional technique such as oven drying, infra red radiation drying, air drying and the like. The thickness of the charge transport layer after drying is from about 10 μm to about 40 μm or from about 12 μm to about 36 μm for optimum photoelectrical and mechanical results. In another embodiment the thickness is from about 14 μm to about 36 μm.

The Adhesive Layer

An optional separate adhesive interface layer may be provided in certain configurations, such as for example, in flexible web configurations. In the embodiment illustrated in FIG. 1, the interface layer would be situated between the blocking layer 14 and the charge generation layer 18. The interface layer may include a copolyester resin. Exemplary polyester resins which may be utilized for the interface layer include polyarylatepolyvinylbutyrals, such as ARDEL POLYARYLATE (U-100) commercially available from Toyota Hsutsu Inc., VITEL PE-100, VITEL PE-200, VITEL PE-200D, and VITEL PE-222, all from Bostik, 49,000 polyester from Rohm Hass, polyvinyl butyral, and the like. The adhesive interface layer may be applied directly to the hole blocking layer 14. Thus, the adhesive interface layer in embodiments is in direct contiguous contact with both the underlying hole blocking layer 14 and the overlying charge generator layer 18 to enhance adhesion bonding to provide linkage. In yet other embodiments, the adhesive interface layer is entirely omitted.

Any suitable solvent or solvent mixtures may be employed to form a coating solution of the polyester for the adhesive interface layer. Solvents may include tetrahydrofuran, toluene, monochlorobenzene, methylene chloride, cyclohexanone, and the like, and mixtures thereof. Any other suitable and conventional technique may be used to mix and thereafter apply the adhesive layer coating mixture to the hole blocking layer. Application techniques may include spraying, dip coating, roll coating, wire wound rod coating, and the like. Drying of the deposited wet coating may be effected by any suitable conventional process, such as oven drying, infra red radiation drying, air drying, and the like.

The adhesive interface layer may have a thickness of at least about 0.01 micrometers, or no more than about 900 micrometers after drying. In embodiments, the dried thickness is from about 0.03 micrometers to about 1 micrometer.

The Ground Strip

The ground strip may comprise a film forming polymer binder and electrically conductive particles. Any suitable electrically conductive particles may be used in the electrically conductive ground strip layer 19. The ground strip 19 may comprise materials which include those enumerated in U.S. Pat. No. 4,664,995. Electrically conductive particles include carbon black, graphite, copper, silver, gold, nickel, tantalum, chromium, zirconium, vanadium, niobium, indium tin oxide and the like. The electrically conductive particles may have any suitable shape. Shapes may include irregular, granular, spherical, elliptical, cubic, flake, filament, and the like. The electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip depends on factors such as the conductivity of the specific conductive particles utilized.

The ground strip layer may have a thickness of at least about 7 micrometers, or no more than about 42 micrometers, or of at least about 14 micrometers, or no more than about 27 micrometers.

The Anti-Curl Back Coating Layer

The anti-curl back coating 1 may comprise organic polymers or inorganic polymers that are electrically insulating or slightly semi-conductive. The anti-curl back coating provides flatness and/or abrasion resistance.

Anti-curl back coating 1 may be formed at the back side of the substrate 2, opposite to the imaging layers. The anti-curl back coating may comprise a film forming resin binder and an adhesion promoter additive. The resin binder may be the same resins as the resin binders of the charge transport layer discussed above. Examples of film forming resins include polyacrylate, polystyrene, bisphenol polycarbonate, poly(4,4'-isopropylidene diphenyl carbonate), 4,4'-cyclohexylidene diphenyl polycarbonate, and the like. Adhesion promoters used as additives include 49,000 (du Pont), Vitel PE-100, Vitel PE-200, Vitel PE-307 (Goodyear), and the like. Usually from about 1 to about 15 weight percent adhesion promoter is selected for film forming resin addition. The thickness of the anti-curl back coating is at least about 3 micrometers, or no more than about 35 micrometers, or about 14 micrometers.

Various exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The example set forth herein below and is illustrative of different compositions and conditions that can be used in practicing the present embodiments. All proportions are by weight unless otherwise indicated. It will be apparent, however, that the embodiments can be practiced with many types of compositions and can have many different uses in accordance with the disclosure above and as pointed out hereinafter.

Example 1

Fabrication of a Stamp Roll for Delivery of Healing Material

A stamp roll was prepared for half the length of a test photoreceptor. The stamp roll was fabricated by imprinting lithography with a methacrylated polyurethane flexible material on the surface of a 6-millimetre aluminium roll. The fabricated protrusion-type pattern had a protrusion diameter of 40 micron, with center-to-center distance of 100 micron and a pattern height of 5 micron. The stamp roll was assembled into a BCR charging photoreceptor cartridge of Xerox "WorkCentre Pro C3545" color printer. A 30 mm drum photoreceptor was prepared by coating with 6-micron low wear overcoat for the delivery testing. To demonstrate the delivery concept, half of the overcoated photoreceptor was inked using the assembled printing system with a commercial grade lubricant (DYNA 4210: 10-20% alkylalkoxysilanes in Heptane solvent), available from DYNA Metro Inc. (Vaughan, Ontario). The drum was then conditioned in A-zone and print tested in A-zone (28° C., 85% Relative Humidity (RH)) to evaluate image quality, specifically halftone and deletion.

Figure 5:
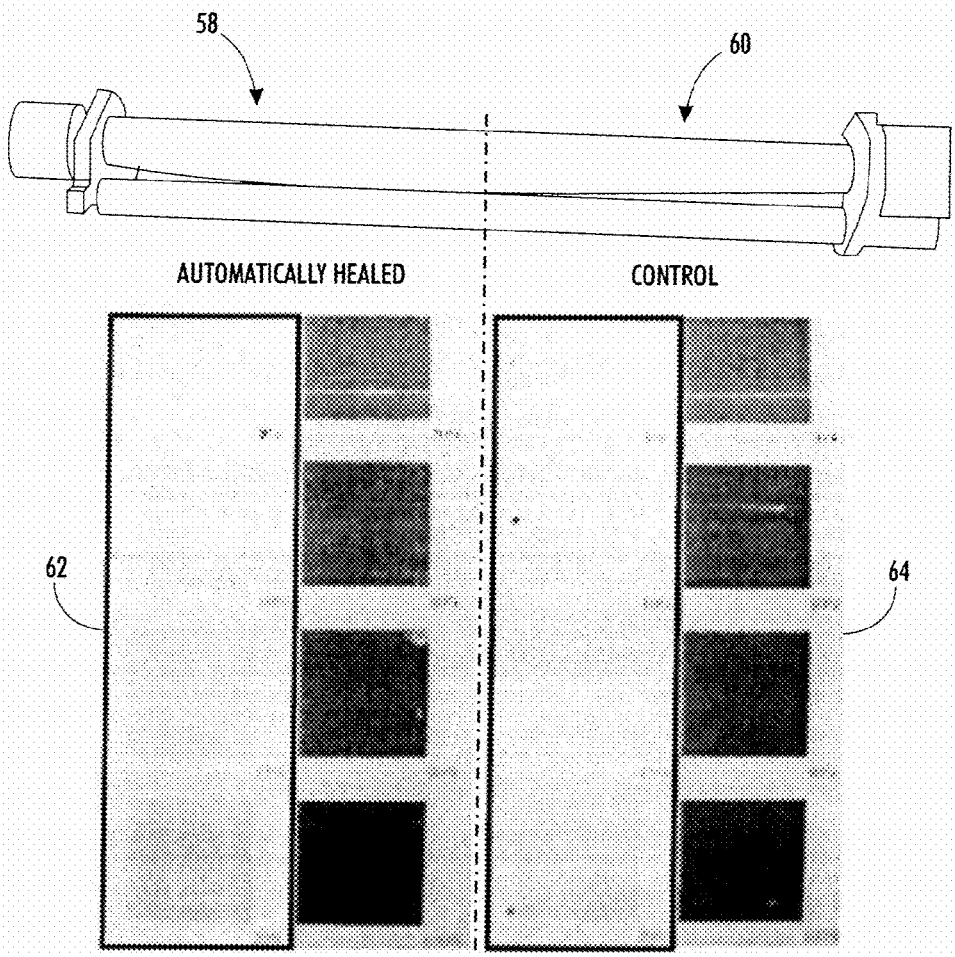
FIG. 5 is an illustration of the results of a print test comparison between a printing system made according to the present embodiments and a control.

The print test was done on a Xerox "WorkCentre Pro C3545" using various image test patterns. The printing test results are shown in FIG. 5. As discussed above, the left half of the photoreceptor drum 58 was nano-inked with DYNA 4210 while the right half was left untreated as a control reference 60. A single page print test with various halftone squares and a central halftone region was completed in A-Zone. The patterns on the left region were xerographically developed with the nano-inked half of the photoreceptor drum 58 while the patterns on the right region were xerographically developed with the untreated half portion of the photoreceptor drum 60. Clearly there is a significant improvement in image quality on the left half 62 with almost deletion-free images. The right half 64 shows severe deletion.

Figure 6:
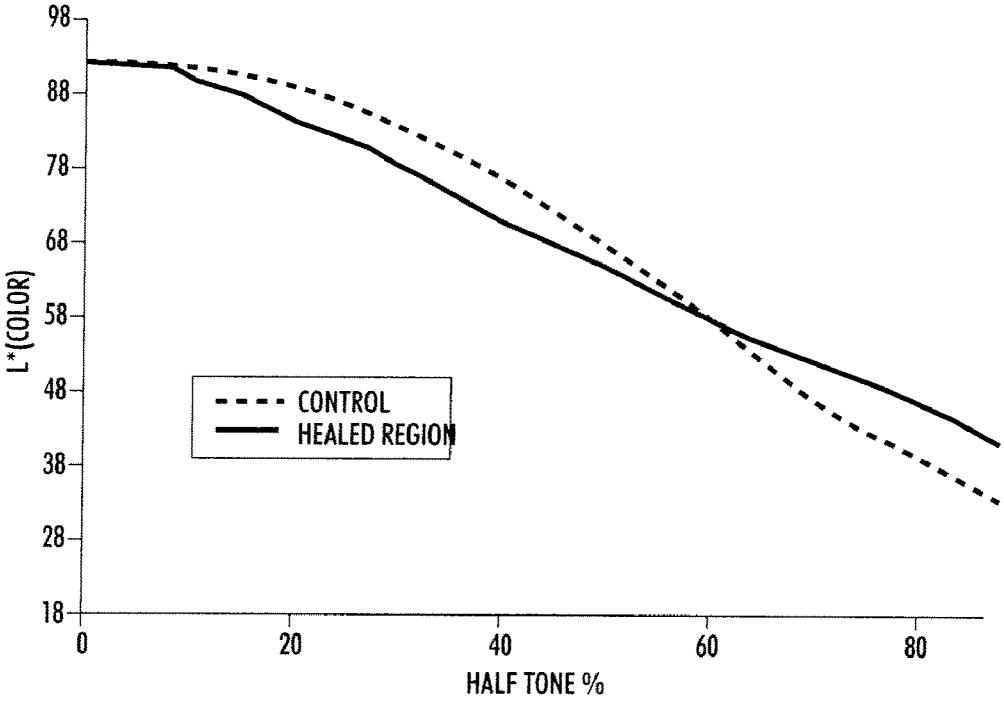
FIG. 6 is a graph depicting the color density measurements of prints produced from a printing system made according to the present embodiments and a control.

The graph depicted in FIG. 6 shows color density measurement of the healed region 58 and control region 60. Automatically healed region shows better linearity than the region without inking, which means A-zone deletion can be healed by automatic healing process well.

In summary, this invention describes a controlled delivery of healing materials, implemented in photoreceptor cartridge, to a photoreceptor surface by transferring thin layer of healing materials. The disclosed embodiments produce a photoreceptor that exhibits substantially reduced wear rates and deletions.

All the patents and applications referred to herein are hereby specifically, and totally incorporated herein by reference in their entirety in the instant specification.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A xerographic image forming apparatus comprising:

a) an imaging member having a charge retentive-surface for developing an electrostatic latent image thereon, wherein the imaging member comprises:
   a substrate, and
   a photoconductive member disposed on the substrate;

b) a holding member holding a source of healing material capable of partially repairing physical or chemical damage to an imaging member surface; and c) a delivery member separate from the imaging member comprising:
   a substrate, and
   an elastic outer layer having a thickness of from about 50 nanometer to about 1000 microns disposed on the substrate, wherein the delivery member cyclically delivers the healing material from the holding member onto a surface of the imaging member through a roll-to-roll method and further wherein a surface of the elastic outer layer has a surface pattern comprising an array of periodically ordered indentations or protrusions on the surface of the elastic outer layer formed to control delivery of the healing material.

2. The xerographic image forming apparatus of claim 1, wherein the elastic outer layer of the delivery member comprises an elastic material selected from the group consisting of polysiloxane, polyurethane, polyester, fluoro-silicone, polyolefin, and mixtures thereof.

3. The xerographic image forming apparatus of claim 1, wherein the indentations or protrusions of the delivery member have a shape selected from the group consisting of circles, rods, ovals, squares, triangles, polygons, and mixtures thereof.

4. The xerographic image forming apparatus of claim 1, wherein each of the indentations or protrusions of the delivery member has a perimeter of from about 5 nanometers to about 200 microns.

5. The xerographic image forming apparatus of claim 1, wherein each of the indentations of the delivery member has a depth of from about 0.5 nanometers to about 100 microns, and wherein each of the protrusions has a height of from about 0.5 nanometers to about 100 microns.

6. The xerographic image forming apparatus of claim 1, wherein the array of indentations or protrusions of the delivery member have a center-to-center distance of from about 5 nanometers to about 500 microns.

7. A xerographic image forming system comprising:

a) a photoreceptor having a charge retentive-surface for developing an electrostatic latent image thereon, wherein the photoreceptor comprises:
   a substrate,
   a charge generating layer disposed on the substrate,
   at least one charge transport layer disposed on the charge generating layer, and optionally
   an overcoat layer disposed on the charge transport layer;

b) a holding member holding a source of healing material capable of partially repairing physical or chemical damage to an imaging member surface;

c) a delivery member separate from the photoreceptor comprising:
   a substrate, and
   an elastic outer layer having a thickness of from about 50 nanometer to about 1000 microns disposed on the substrate, wherein the delivery member cyclically delivers the healing material from the holding member onto a surface of the imaging member through a roll-to-roll method and further wherein a surface of the elastic outer layer has a pattern comprising an array of periodically ordered indentations or protrusions on the surface of the elastic outer layer formed to control delivery of the healing material and further;

d) a charging and exposure unit for developing an electrostatic image on the photoreceptor surface;

e) a toner developer component for applying a developer material to the charge-retentive surface of the photoreceptor to form a developed image on the charge-retentive surface;

f) a transfer component for transferring the developed image from the charge-retentive surface to a copy substrate; and g) a cleaning component for cleaning remaining toner particles.

8. The xerographic image forming system of claim 7, wherein the delivery member is a stamp roll.

9. The xerographic image forming system of claim 7, wherein the delivery member is placed between charging component and cleaning component.

10. The xerographic image forming system of claim 7, wherein the holding member is a sponge containing the healing material.

11. The xerographic image forming system of claim 7, wherein the elastic outer layer of the delivery member comprises an elastic material selected from the group consisting of polysiloxane, polyurethane, polyester, fluoro-silicone, and mixtures thereof.

12. The xerographic image developing system of claim 7, wherein the indentations or protrusions of the delivery member have a regular shape selected from the group consisting of circles, rods, ovals, squares, triangles, polygons, and mixtures thereof.

13. The xerographic image forming system of claim 7, wherein each of the indentations or protrusions of the delivery member has a perimeter of from about 5 nanometers to about 200 microns.

14. The xerographic image forming system of claim 7, wherein each of the indentations of the delivery member has a depth of from about 0.5 nanometers to about 10 microns, and wherein each of the protrusions has a height of from about 0.5 nanometers to about 10 microns.

15. The xerographic image forming system of claim 7, wherein the indentations or protrusions of the delivery member have a two-dimensional periodicity from hexagonal arrays, tetragonal arrays, quasi-crystal arrays, and linear arrays, and mixtures thereof.

16. The xerographic image forming system of claim 7, wherein the array of indentations or protrusions of the delivery member have a center-to-center distance of from about 5 nanometers to about 500 microns.

17. An image forming method for xerographic image forming system comprising:

providing the xerographic image forming system of claim 7;

applying a healing material onto the surface of the photoreceptor surface through the delivery member;

developing an electrostatic image on the photoreceptor surface containing healing material through charging and exposure unit;

developing a toner image onto the photoreceptor surface through the toner developer component;

transferring the toner image to a printing substrate through the transfer component; and removing residual toner material from the photoreceptor through the cleaning component.

18. The image forming method of claim 17, wherein the delivery member comprises an elastic outer layer with a surface pattern comprising an array of periodically ordered indentations or protrusions on the surface of the elastic outer layer and each of the indentations or protrusions of the delivery member has a perimeter of from about 5 nanometers to about 200 microns and a depth of from about 0.5 nanometers to about 10 microns, and wherein each of the protrusions has a height of from about 0.5 nanometers to about 10 microns.

* * * * *